US005337769A

United States Patent [19]

Howe

[11] Patent Number: 5,337,769

[45] Date of Patent: Aug. 16, 1994

[54] PAINT ROLLER COVER CLEANING DEVICE

[76] Inventor: Michael E. Howe, 390 East St., Bloomsburg, Pa. 17815

[21] Appl. No.: 97,081

[22] Filed: Jul. 23, 1993

[51] Int. Cl.[5] ..... B08B 3/02

[52] U.S. Cl. ..... 134/138; 134/183; 134/900

[58] Field of Search ..... 134/182, 183, 138, 900, 134/144, 157, 201; 68/213

[56] References Cited

U.S. PATENT DOCUMENTS

| | | | |
|---|---|---|---|
| D. 280,144 | 8/1985 | Cooney | D33/35 |
| 2,831,488 | 4/1958 | Anderson | 134/138 |
| 3,037,516 | 6/1962 | Leach | 134/900 |
| 3,126,899 | 3/1964 | Caywood | 134/900 |
| 4,402,333 | 9/1983 | Frizzell et al. | 134/900 X |
| 4,549,562 | 10/1985 | Ossi | 134/138 |
| 4,623,186 | 11/1986 | Chavarria et al. | 134/183 |
| 4,708,152 | 11/1987 | Hibberd | 134/138 |
| 4,709,717 | 12/1987 | Rannigan et al. | 134/199 |
| 4,733,679 | 3/1988 | Dolcater | 134/138 |
| 4,768,534 | 9/1988 | Anderson | 134/138 |
| 4,809,722 | 3/1989 | Pennise | 134/138 |
| 4,811,749 | 3/1989 | Dixon | 134/184 |
| 4,832,066 | 5/1989 | Shipman | 134/900 |
| 5,033,491 | 7/1991 | Middleton . | |

FOREIGN PATENT DOCUMENTS

| | | | |
|---|---|---|---|
| 2949544 | 6/1981 | Fed. Rep. of Germany | 134/900 |

*Primary Examiner*—Frankie L. Stinson
*Attorney, Agent, or Firm*—Eckert Seamans Cherin & Mellott

[57] ABSTRACT

Disclosed is a paint roller cover cleaning device comprising a drum having a perforated base, a cylindrical sidewall and an open top fitted with a removable lid. The device has a support member for frictionally engaging a paint roller cover rotatably secured to the base of the drum. The cylindrical sidewall has a vertical slot opening that allows the user to selectively direct a pressurized stream of solvent from a nozzle against the outer periphery or nap of the paint roller cover.

3 Claims, 2 Drawing Sheets

PAINT ROLLER COVER CLEANING DEVICE

BACKGROUND OF THE INVENTION

This invention relates to a device for cleaning paint rollers covers. It relates particularly to a device for cleaning paint rollers covers that can be easily used by both the commercial painter and the homeowner.

The well-know paint roller assembly is commonly used by both commercial painters and homeowners for fast and efficient painting of flat wall and ceiling surfaces using a various types of paints and other finishes. The paint roller assembly comprises a handle attached to a rotatable cylinder or wire frame which fits into and frictionally holds a removable roller cover. The paint roller assembly allows for rotation of the roller cover to pickup paint from a tray or container and to toll a thin layer of the paint over flat surfaces, such as a wall or ceiling.

The paint roller cover is comprised of an inner plastic or cardboard cylindrical tube covered with a nap made of fabric, fibers or plastic capable of absorbing and distributing paint. The nap may be a carpet-like fabric, a plastic foam, a tufted fiber or any other type of outer covering that will hold and apply paint or other finishes uniformly to a flat surface.

After use, the paint roller cover is either cleaned for reuse or discarded. Many paint roller covers, especially those with a heavy nap, are expensive and therefore justify cleaning for reuse. Cleaning usually involves either soaking the paint roller cover in a suitable paint solvent or, in the case of a typical homeowner using water soluble latex paints, washing the paint roller cover in an open sink with soap and water. Cleaning a paint roller cover is usually a somewhat messy operation involving the splattering of paint and solvent, and unless carefully done, usually does not remove all the residual paint from the nap of the paint roller cover. As a result, commercial and professional painters avoid the inconvenience and mess required to clean roller covers and discard the roller cover after use.

Several different types of prior paint roller cover cleaning devices are described in the following U.S. Pat. Nos.:

| | | | |
|---|---|---|---|
| U.S. Pat. No. | D280,144 | Cooney | 1985 |
| U.S. Pat. No. | 4,549,562 | Ossi | 1985 |
| U.S. Pat. No. | 4,709,717 | Rannigan | 1987 |
| U.S. Pat. No. | 4,733,679 | Dolcater | 1988 |
| U.S. Pat. No. | 4,811,749 | Dixon | 1989 |
| U.S. Pat. No. | 5,033,491 | Middleton | 1991 |

The devices shown in these prior patents attempt to reduce the splatter and mess produced when cleaning a paint roller cover by enclosing the paint roller cover in a protective shield or cover. While the splatter and mess will be reduced with some of these prior patented devices, many of these prior cleaning devices will not effectively clean the residual paint from the nap of the paint roller cover, which then hardens and reduces the effectiveness of the nap.

For example, U.S. Pat. Nos. 4,733,679 to Dolcater and 5,033,491 to Middleton disclose devices that enclose the roller cover within a close fitting tubular vessel and flood the paint roller cover with water or solvent from a spray tube or manifold built into the tubular vessel. Such devices are unable to direct the water or solvent selectively to those portions of the roller cover that need the most cleaning. In addition, the close fitting of the tubular vessel of these prior devices about the paint roller cover tends to reintroduce a mixture of paint and water or solvent back onto the nap of the roller cover during the cleaning operation and requires considerable time and quantities of solvent to clean the paint roller cover. As a result, both the commercial and professional painter and the homeowner have found such prior cleaning devices unsatisfactory and usually discard the paint roller after use rather than attempt to clean it for reuse.

SUMMARY OF THE INVENTION

It is therefore an object of this invention to provide a paint roller cover cleaning device that reduces the splatter and mess usually associated with cleaning of a paint roller cover.

It is another object of this invention to provide a paint roller cover cleaning device that is simple, inexpensive and easy to use both by commercial or professional painters or a homeowner.

It is a still further object of this invention to provide a paint roller cover cleaning device that is more effective than prior devices for cleaning the paint roller cover, especially those paint roller covers that have a heavy nap or are used with heavy paints and finishes.

It has been discovered that the foregoing objects can be attained by a paint roller cover cleaning device comprising a drum having a perforated base, a cylindrical sidewall and an open top fitted with a removable lid. A support member for frictionally engaging a paint roller cover is rotatably secured to the base of the drum. The cylindrical sidewall of the drum is provided with a vertical slot therein that allows the user to selectively direct a concentrated stream of water or solvent against the surface of the roller cover.

DESCRIPTION OF THE PREFERRED EMBODIMENTS

Figure 1:
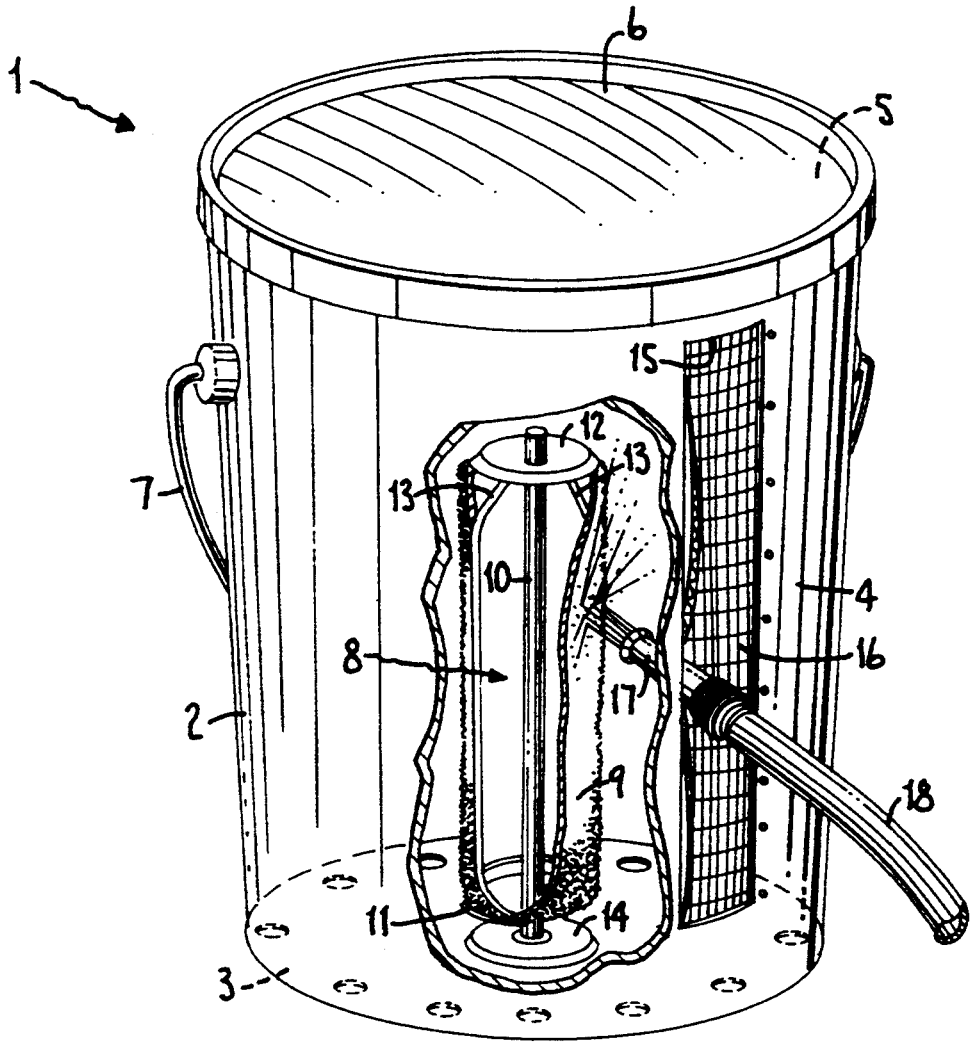
FIG. 1 is an isometric view of a preferred embodiment of the paint roller cover cleaning device of this invention with portions broken away for clarity of illustration.

FIG. 1 illustrates an isometric view, with portions broken away for clarity of illustration, of a preferred embodiment of the paint roller cover cleaning device 1 of this invention. As shown in FIG. 1, the paint roller cover cleaning device 1 is comprised of a drum or pail 2, having a perforated base 3, a cylindrical sidewall 4 and an open top 5 fitted with a removable lid 6. If desired, the drum or pail 2 may be provided with a carrying handle or bail 7. The drum or pail 2 is preferably made of plastic for lowest cost, but could also be made of galvanized steel or aluminum. A drum or pail 2 found suitable for this invention is a five gallon capacity, one-piece molded high density polyethylene pail, about 14 inches (36 cm.) high, about 12 inches (31 cm.) in diameter at the top and tapered slightly toward the base and having a plastic snap-on lid. Such a drum or pail 2 is commonly used to transport detergents, food and many chemicals.

Secured to the center of the base 3 of the drum or pail 2 is a wire cage type of support member 8 for frictionally holding a cylindrical paint roller cover 9 in an upright position above the base 3. The support member 8 is preferably the type attached to the handle of a paint roller assembly and is comprised of a central shaft 10, a bottom support bearing 11 and a top support bearing 12 rotatable about the central shaft 10 and connected by a plurality of curved support wires or rods 13 that are adapted to frictionally engage the inner surface of the paint roller cover 9 and also allow its easy removal. The base 3 of the drum or pail is preferably also provided with a metal support collar 14 that strengthens the base 3 of the drum or pail 2 and provides a bearing point for central shaft 10 of support member 8.

Figure 2:
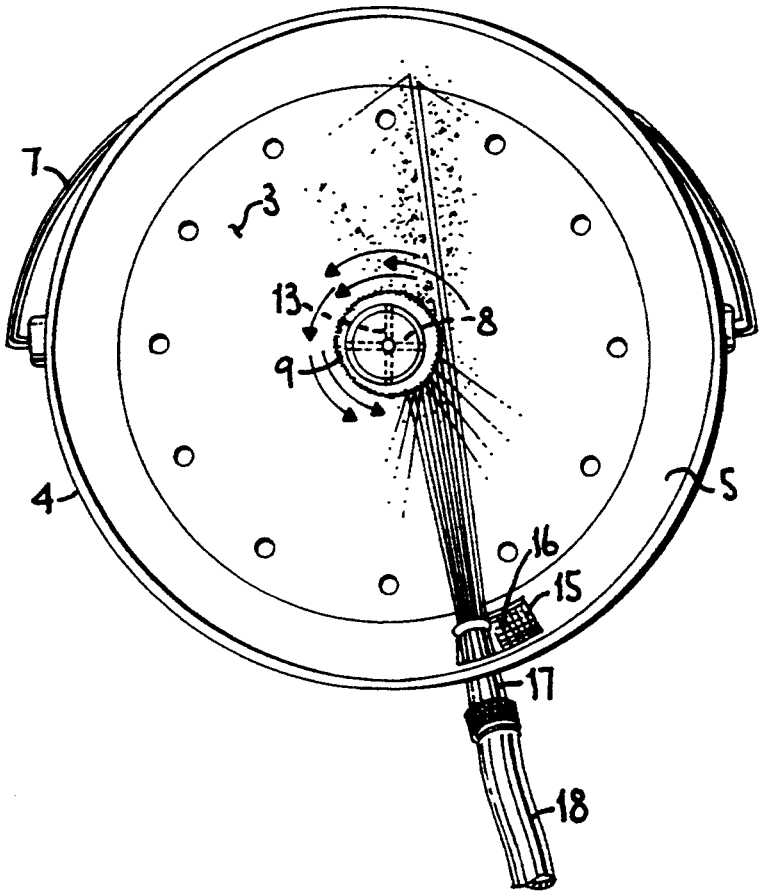
FIG. 2 is a top view of a preferred embodiment of the paint roller cover cleaning device of this invention with the lid on the top of the drum removed for clarity of illustration.

As best illustrated in FIG. 1, the cylindrical sidewall 4 of the drum or pail 2 is provided with a vertical slot 15 about 12 inches (31 cm.) long and about 1.5 inches (4 cm.) wide covered with a flexible plastic or rubber flap 16 secured to the inner surface of the cylindrical sidewall 4 of the drum or pail 2. As shown in FIG. 1, the vertical slot 15 extends substantially from the base 3 of the drum or pail 2 to a height at least equal to the height of the roller cover 9 when mounted on the support member 8 within the interior of the drum or pail 2. As shown in FIGS. 1 and 2, the base 3 of the drum or pail 2 is provided with a plurality of perforations to allow for the drainage of the water or solvent. If desired, additional perforations may be placed in the cylindrical sidewall 4 adjacent to the base 3 of the drum or pail 2.

The paint roller cover cleaning device 1 of this invention is typically used as follows. A used, paint saturated cylindrical paint roller cover 9 is slipped onto the support member 8 attached to the base 3 of the drum and pail until it is in the position illustrated in FIG. 1. The lid 6 is then placed on the open top 5 of the drum or pail 2. If the paint used with the paint roller cover 9 was a water soluble latex paint, the user then inserts an ordinary garden hose nozzle 17 attached to a hose 18 and a source of water under pressure, into the vertical slot 15 and positions the nozzle 17 so that the water under pressure emitted from the nozzle 17 will strike the outer periphery or nap of the paint roller cover 9 tangentially. causing the paint roller cover 9 and its support member 8 to rotate about the central shaft 10 from the tangential force of the water. This rotation produces a centrifugal force at the outer periphery or nap of the paint roller cover 9 that causes the paint and water mixture in the nap to be forcibly thrown against the inner surface of the cylindrical sidewall 4 of the drum or pail 2 where it then collects and flows downwardly and out the perforations in the base 3 and into a drain or other collecting vessel. For paints and finishes that are not water soluble, the hose 18 and nozzle 17 would be attached to a source of suitable solvent or cleaning solution under pressure, which solvent or solution could then be collected and recycled by placing a collecting vessel under the drum or pail 2.

After the paint roller cover 9 has been adequately cleaned, the lid 6 is removed form the open top 5 of the drum or pail 2 and the cleaned paint roller cover 9 is removed upwardly from the support member 8 by the user.

Unlike prior cleaning devices, the inner surface of the cylindrical sidewall 4 of the drum or pail 2 is spaced sufficiently from the outer periphery or nap of the paint roller cover 9, so that the paint and water mixture does not splash back of is not reintroduced back onto the nap of the paint roller cover 9 during the cleaning operation. It has been observed that if the diameter of the inner surface of the cylindrical sidewall 3 of the drum or pail 2 is at least equal to or greater than three (3) times the outer diameter of the paint roller cover 9, such backsplash or reintroduction of the paint and water mixture onto the nap of the paint roller cover 9 does not occur during the cleaning operation.

The use of hand held nozzle 17 instead of a fixed spray tube or manifold used in prior cleaning devices, allows the user to selectively direct the stream of water or solvent against those portions of the paint roller cover 9 that need extra cleaning or to control the speed of rotation of the paint roller cover, especially during the end of the cleaning operation where a very high rotational speed will effectively remove almost all of the cleaning water or solvent from the nap of the paint roller cover 9.

The ability to use an ordinary garden hose 18 and nozzle 17 instead of special hoses and manifolds appeals to professional and commercial painters and especially to the homeowner since such a hose and nozzle are usually available at most painting locations.

The drum or pail 2, when not used for cleaning, can be used to store or carry paint rollers or other painting supplies and is suitable for use in most painting locations. Its relatively low cost and simple operation will allow the commercial and professional painter and the homeowner to greatly reduce the cost of paint roller covers by allowing a simple, effective and completely contained paint roller cover cleaning operation.

Although this invention has been described and illustrated in detail with reference to a specific preferred embodiment thereof, it will be understood that variations may be made without departing from the scope of this invention as described above and as claimed.

I claim:

1. A paint roller cover cleaning device comprising a drum having a perforated base, a cylindrical sidewall and an open top fitted with a removable lid, a support member for fictionally engaging a paint roller cover, said support member having a central shaft rotatably secured to the center of the base of said drum by a metal support collar and bearing, said cylindrical sidewall having a vertical slot opening therein adapted for the insertion and vertical movement of a hand held nozzle and hose attached to a source of solvent under pressure, said vertical slot opening extending substantially from the base of said drum to a height at least equal to the top of said roller cover when mounted on said support member and said slot opening provided with a flexible flap attached to only one edge thereof.

2. The paint roller cover cleaning device of claim 1 in which the inside diameter of said cylindrical sidewall is equal to or greater than three times the outside diameter of the paint roller cover.

3. The paint roller cover cleaning device of claim 1 in which the solvent is water.

* * * * *